US008561400B2

(12) United States Patent
Nakamura et al.

(10) Patent No.: US 8,561,400 B2
(45) Date of Patent: Oct. 22, 2013

(54) HYDRAULIC CIRCUIT OF INJECTION CYLINDER IN DIE-CASTING APPARATUS

(75) Inventors: Takao Nakamura, Akashi (JP); Akihiro Yamanaka, Akashi (JP); Hiroshi Yukutomo, Akashi (JP); Kenji Fujii, Akashi (JP)

(73) Assignee: Toyo Machinery & Metal Co., Ltd., Hyogo (JP)

( * ) Notice: Subject to any disclaimer, the term of this patent is extended or adjusted under 35 U.S.C. 154(b) by 500 days.

(21) Appl. No.: 13/060,405

(22) PCT Filed: Nov. 4, 2008

(86) PCT No.: PCT/JP2008/070054

§ 371 (c)(1),
(2), (4) Date: Feb. 23, 2011

(87) PCT Pub. No.: WO2010/038321

PCT Pub. Date: Apr. 8, 2010

(65) Prior Publication Data

US 2011/0180166 A1 Jul. 28, 2011

(30) Foreign Application Priority Data

Oct. 1, 2008 (JP) ..... 2008-256370

(51) Int. Cl.
*F15B 13/044* (2006.01)

(52) U.S. Cl.
USPC ..... 60/463; 60/465

(58) Field of Classification Search
USPC ..... 91/419, 462, 463, 465
See application file for complete search history.

(56) References Cited

U.S. PATENT DOCUMENTS

| | | | | |
|---|---|---|---|---|
| 5,138,838 A * | 8/1992 | Crosser | ..... | 91/463 |
| 5,737,992 A * | 4/1998 | Torrekens et al. | ..... | 91/465 |
| 6,626,082 B2 * | 9/2003 | Morita et al. | ..... | 91/465 |

FOREIGN PATENT DOCUMENTS

| | | |
|---|---|---|
| JP | 60-033863 A | 2/1985 |
| JP | 04-051260 B2 | 8/1992 |
| JP | 07-293508 A | 11/1995 |
| JP | 08-132218 A | 5/1996 |

* cited by examiner

*Primary Examiner* — Michael Leslie
(74) *Attorney, Agent, or Firm* — Lucas & Mercanti, LLP

(57) ABSTRACT

A hydraulic circuit of an injection cylinder in a die-casting apparatus, which can achieve IN restriction and OUT restriction in a quickly switchable manner with a single circuit and which allows manufacturing of a high-quality molded product. The hydraulic circuit includes: a first pressure oil path supplying pressure oil to the injection cylinder; a second pressure oil path returning the pressure oil from the injection cylinder; a first flow control valve controlling a flow of the pressure oil through the first pressure oil path; a second flow control valve controlling a flow of the pressure oil through the second pressure oil path; a bypass pressure oil path connected to the second pressure oil path for bypassing the second flow control valve; a bypass on-off valve provided on the bypass pressure oil path and opening/closing the bypass pressure oil path with the pressure oil; and a controller controlling each valve.

2 Claims, 10 Drawing Sheets

HYDRAULIC CIRCUIT OF INJECTION CYLINDER IN DIE-CASTING APPARATUS

This is a 371 of PCT/JP2008/070054 filed Nov. 4, 2008, which in turn claimed the priority of JP2008-256370 filed Oct. 1, 2008, both applications are incorporated herein by reference.

BACKGROUND OF THE INVENTION

1. Field of the Invention

The present invention relates to a hydraulic circuit which controls a piston movement of an injection cylinder which moves a plunger of a die-casting apparatus forward/backward.

2. Description of the Related Art

In general, in a die-casting apparatus, when an injection speed, an injection pressure, or the like, of a molten metal is inappropriate, various defects occur in a molded product. For example, when the injection speed is low or when the injection pressure is low, filling of a mold cavity with the molten metal becomes poor, and thus a defect occurs in a molded product. On the other hand, when the injection speed is high or when the injection pressure is high, filling of the mold cavity with the molten metal becomes good, but the molten metal enters between mating faces of the mold and burrs occur in a molded product.

Therefore, conventionally, for controlling an injection speed, an injection pressure, or the like, of a molten metal, a hydraulic circuit A1 or A2 as, shown in FIG. 9 is provided at an injection cylinder C which moves a plunger forward/backward, whereby the injection speed of the molten metal is controlled.

The hydraulic circuit A1 or A2 includes: an inflow circuit 3 which flows a pressure oil from a pressure oil source 1 such as a hydraulic pump or an accumulator through a switching valve 2 into a piston rear chamber R1 of the injection cylinder C; and an outflow circuit 5 which returns the pressure oil flowing out from a piston front chamber R2 of the injection cylinder C, to an on tank 4 through the switching valve 2. In the hydraulic circuit A1 for so-called "IN restriction" shown in FIG. 9(*a*), a flow control valve 6 is provided between the piston rear chamber R1 and the switching valve 2 in the inflow circuit 3. In such a hydraulic circuit A1 for IN restriction, in which the flow control valve 6 is provided, the pressure oil returned from the piston front chamber R2 through the outflow circuit 5 to the oil tank 4 by a movement of a piston P does not have resistance, and thus mechanically movable parts such as the piston P and a piston rod Pr connected thereto have great inertial forces, whereby a molten metal can be pressed into a cavity at a maximum pressure. Therefore, a mold for IN restriction, which has a small supply port, is installed in a die-casting apparatus which employs the hydraulic circuit A1 for IN restriction as an injection speed control circuit for the molten metal.

On the other hand, in the hydraulic circuit A2 for so-called "OUT restriction" shown in FIG. 9(*b*), a flow control valve 7 is provided between the piston front chamber R2 and the switching valve 2 in the outflow circuit 5. In such a hydraulic circuit A2 for OUT restriction, in which the flow control valve 7 is provided, the inertial forces of the mechanically movable parts such as the piston P and the piston rod Pr can be controlled by controlling a flow of the pressure oil flowing out from the piston front chamber R2, and thus it is easy to adjust the injection speed of the molten metal. However, the piston P receives resistance due to a back pressure generated when the flow at the flow control valve 7 is reduced, and the pressure which presses the molten metal into the cavity may be reduced. Therefore, a mold for OUT restriction, which has a large supply port, is installed in a die-casting apparatus which employs the hydraulic circuit A2 for OUT restriction as an injection speed control circuit for the molten metal.

As described above, regarding a hydraulic circuit of an injection cylinder which controls an injection speed of a molten metal, characteristics of the hydraulic circuit A1 for IN restriction and characteristics of the hydraulic circuit A2 for OUT restriction are greatly different from each other, and each hydraulic circuit needs a different mold according to its characteristics. Thus, for example, when a mold for OUT restriction, which has a large supply port, is installed in a die-casting apparatus which includes the hydraulic circuit A1 for IN restriction as a hydraulic circuit of an injection cylinder, the molten metal is rapidly supplied into a cavity of the mold while having a high pressure, and thus burrs occurs.

In contrast, as a hydraulic circuit of an injection cylinder, which is suitable for both a mold for IN restriction and a mold for OUT restriction, there is a circuit, as shown in FIG. 10, in which a first flow control valve 8 is provided in an inflow circuit 3 to a piston rear chamber R1, a second flow control valve 9 is provided in an outflow circuit 5 from a piston front chamber R2, and an opening degree of the second flow control valve 9 is controlled so as to correspond to an opening degree of the first flow control valve 8 (e.g., Patent Document 1: Japanese Laid-Open Patent Publication No. 60-33863).

According to this hydraulic circuit, when a mold for IN restriction is installed, control is performed such that the opening degree of the second flow control valve 9 is higher than the opening degree of the first flow control valve 8. On the other hand, when a mold for OUT restriction is installed, control is performed such that the opening degree of the second flow control valve 9 is reduced so as to be lower than the opening degree of the first flow control valve 8.

BRIEF SUMMARY OF THE INVENTION

However, in the hydraulic circuit shown in FIG. 10, since the opening degree of the second flow control valve 9 is controlled so as to correspond to the opening degree of the first flow control valve 8, characteristics of the hydraulic circuit for each of IN restriction and OUT restriction are achieved in a halfway manner. In addition, since the entire hydraulic circuit is controlled by simultaneously controlling the opening degrees of the two flow control valves 8 and 9, very delicate control is required. Moreover, in such a hydraulic circuit which simultaneously controls the opening degrees of the two flow control valves 8 and 9, small imbalance destabilizes an operation of the injection cylinder C, and thus it is difficult to obtain a high-quality molded product (die-cast product).

Therefore, a main object of the present invention is to provide a hydraulic circuit of an injection cylinder in a die-casting apparatus, which can achieve IN restriction and OUT restriction in a quickly switchable manner with a single circuit, which can achieve an advanced injection method having characteristics of both IN restriction and OUT restriction, and which allows manufacturing of a molded product having a higher quality as compared to that of a conventional product.

According to the first aspect of the present invention, a hydraulic circuit 10 of an injection cylinder C in a die-casting apparatus 12, the hydraulic circuit comprising:

a first pressure oil path 30 which supplies a pressure oil from a pressure oil source 46 to a piston rear chamber R1 of the double-acting injection cylinder C which moves forward/backward a plunger 26 connected to a piston rod Pr;

a second pressure oil path 32 which returns the pressure oil from a piston front chamber R2 of the injection cylinder C to an oil tank 48;

a first flow control valve 34 which controls a pressure oil flow amount in the first pressure oil path 30;

a second flow control valve 36 which controls a pressure oil flow amount in the second pressure oil path 32;

a bypass pressure oil path 38 which is connected to the second pressure oil path 32 so as to bypass the second flow control valve 36;

a bypass on-off valve 40 which is mounted on the bypass pressure oil path 38 and has a pressure oil flow amount per unit time which is larger than the pressure oil flow amount of the first flow control valve 34 per unit time; and a controller 44 which controls operations of the first flow control valve 34, the second flow control valve 36, and the bypass on-off valve 40, wherein the controller 44 has a function:

in the case of IN restriction control, at injection, at least before start of a forward movement of the piston rod Pr, to close the second flow control valve 36, open the bypass on-off valve 40, and open the first flow control valve 34 to a predetermined opening degree; and in the case of OUT restriction control, at injection, to open the second flow control valve 36, close the bypass on-off valve 40, and open the first flow control valve 34, thereby controlling the second flow control valve 36 such that the pressure oil flow amount of the second flow control valve 36 per unit time is smaller than the pressure oil flow amount of the first flow control valve 34 per unit time and becomes a predetermined value.

Since the controller 44 is configured as described above, the hydraulic circuit 10 can be quickly and completely switched to IN restriction or OUT restriction with a single machine by controlling the operations of the first flow control valve 34, the second flow control valve 36, and the bypass on-off valve 40.

An opening degree of the first flow control valve 34 may be adjusted by a motor M, the bypass on-off valve 40 may be a direction logic valve which opens/closes the bypass pressure oil path 38 with the pressure oil from the pressure oil source 46 being as a pilot signal, and the hydraulic circuit 10 may further comprises:

a first direction switching valve 35 which is controlled by the controller 44 so as to open/close the first flow control valve 34; and a second direction switching valve 42 which switches a flowing direction of the pressure oil provided as the pilot signal to the direction logic valve 40, by the controller 44.

The controller 44 may further has a function at injection:

at least before the start of the forward movement of the piston rod Pr, to close the bypass on-off valve 40, open the first and second flow control valves 34 and 36, and control at least one of the first and second flow control valves 34 and 36 such that the pressure oil flow amount of the second flow control valve 36 per unit time is larger than the pressure oil flow amount of the first flow control valve 34 per unit time; and at a time when the piston rod Pr moves forward to a set position P2, to reduce an opening degree of the second flow control valve 36 such that the pressure oil flow amount of the second flow control valve 36 per unit time is smaller than the pressure oil flow amount of the first flow control valve 34 per unit time and follows a set value.

The hydraulic circuit 10 in IN restriction, in which power is high and filling with the molten metal for a product is good, is formed from the start of an injection operation of the injection cylinder C to the time immediately before the end of the injection operation, and the hydraulic circuit 10 in OUT restriction, in which speed adjustment is easy, is formed from the time immediately before the end of the injection operation of the injection cylinder C, at which fine speed control is required, to the end of the injection operation. Thus, a surge pressure can be prevented from excessively occurring in the cavity 22 so as to exceed a clamping force at the time immediately before the end of the injection operation at which the cavity 22 is substantially filled with a molten metal, and burrs, which are unique to a die-cast product and occur at a periphery of the product due to the molten metal entering between movable and fixed molds, can be eliminated. In addition, a fixed mold having a large supply port as well as a fixed mold having a small supply port can be used in this apparatus, whereby the emitted speed of the molten metal is increased and the entire cavity is sufficiently filled with the molten metal. Therefore, a high-quality die-cast product which has no defect in shape can be manufactured.

Here, the "set position" is a position at which a surge pressure detected in the cavity 22 exceeds a value which causes occurrence of burrs. When a position at which a surge pressure increases is previously known, this position can also be set as an IN-OUT restriction switching control position.

According to the present invention, a hydraulic circuit of an injection cylinder in a die-casting apparatus, which can achieve IN restriction and OUT restriction in a quickly switchable manner with a single circuit and which allows manufacturing of a high-quality molded product which has not existed, can be provided.

DETAILED DESCRIPTION

Hereinafter, the present invention will be described in detail by way of embodiments with reference to the drawings.

Figure 1:
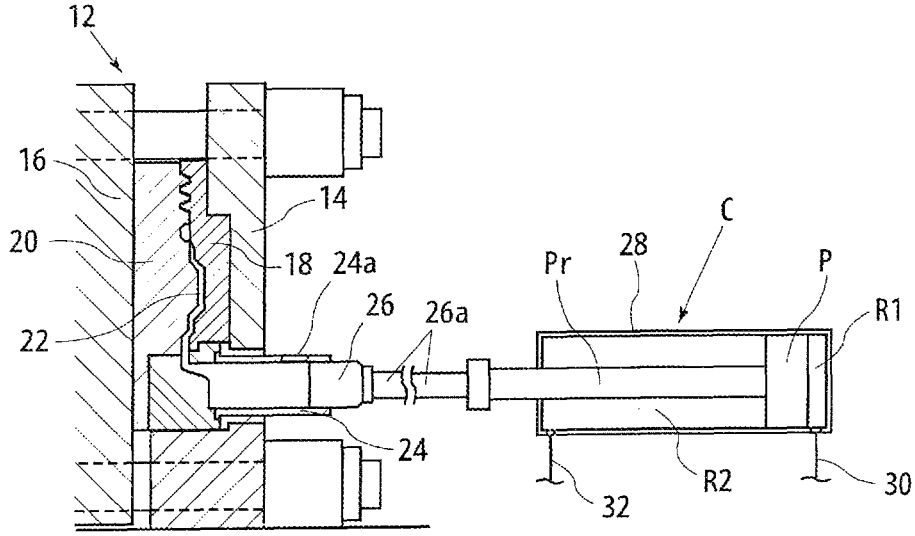
FIG. 1 is a schematic diagram showing a main portion of a die-casting apparatus in which a hydraulic circuit of the present invention is used.
Figure 2:
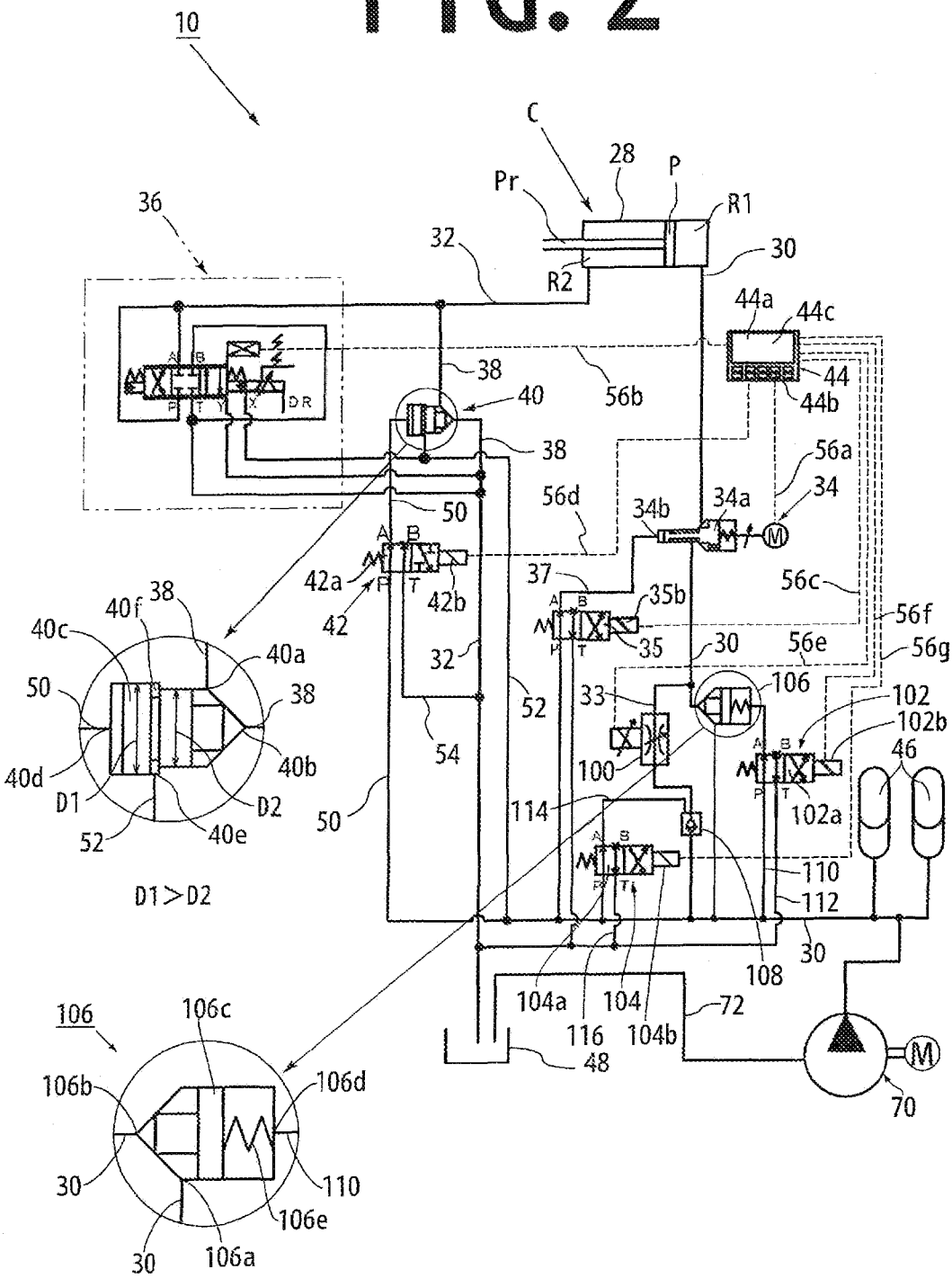
FIG. 2 is a circuit diagram showing a main portion of the hydraulic circuit of the present invention.

FIG. 1 is a schematic diagram showing a main portion of a die-casting apparatus 12 in which a hydraulic circuit of the present invention is used. In addition, FIG. 2 is a circuit diagram showing a main portion of the hydraulic circuit 10 of the present invention. In FIG. 1, reference numeral 14 denotes a fixed die plate, reference numeral 16 denotes a movable die plate, reference numeral 18 denotes a fixed mold, and reference numeral 20 denotes a movable mold, and reference numeral 22 denotes a cavity.

A cylindrical sleeve 24 is mounted to the fixed die plate 14 among these components and is provided with a supply port 24*a* at its upper portion, and its inside communicates with the cavity 22. A plunger 26 is slidably inserted into the sleeve 24. Then, an injection cylinder C is connected to the plunger 26, and serves to move the plunger 26 forward/backward in the sleeve 24.

The injection cylinder C includes a closed cylinder body 28 having a cylindrical shape, and a piston P is accommodated in the cylinder body 28 so as to be slidable in an axial direction thereof. Thus, the inner space of the cylinder body 28 is divided into a piston rear chamber R1 and a piston front chamber R2. In addition, a long piston rod Pr is mounted on the piston front chamber R2 side of the piston P, is connected at one end thereof to the piston P, projects at another end thereof to the outside of the cylinder body 28, and is connected at the other end thereof to the plunger 26 through the plunger rod 26*a*.

The hydraulic circuit 10 as shown in FIG. 2 is connected to the injection cylinder C. Generally, the hydraulic circuit 10 includes a first pressure oil path 30, a second pressure oil path 32, a third pressure oil path 33, a first flow control valve 34, a second flow control valve 36, a third flow control valve 100, a bypass pressure oil path 38, a bypass on-off valve (e.g., a direction logic valve) 40, first, second, third, and fourth direction switching valves 35, 42, 102, and 104, a logic valve 106, a pilot operation check valve 108, a controller 44, and another piping system.

The first pressure oil path 30 is a flow path which communicates at one end thereof with the piston rear chamber R1 of the injection cylinder C and is connected at another end thereof to a pressure oil source 46, such as an accumulator, to which a pressure oil is supplied from a hydraulic pump 70, thereby supplying the pressure oil to the piston rear chamber R1. The first flow control valve 34 is mounted on the first pressure oil path 30, and the logic valve 106 is also mounted on the first pressure oil path 30 on the pressure oil source 46 side of the first flow control valve 34.

The first flow control valve 34 serves to control a flow of the pressure oil flowing in the first pressure oil path 30. The hydraulic circuit 10 of the present embodiment employs, as the first flow control valve 34, a flow control valve (so-called high flow controller) which controls its valve opening degree from full closing of a flow path to full opening of the flow path by drive of a pulse motor or a servo motor and can quickly respond to a predetermined flow, that is, which has high-speed responsivity. Valve opening/closing for the controlled valve opening degree of the first flow control valve 34 shown in the illustrated embodiment is performed on the basis of balance between supply/block of the pressure oil from the first direction switching valve 35 and an urging force of a built-in spring. Note that the first flow control valve 34 is not limited thereto, and any valve may be used as long as it can control the flow of the pressure oil. In addition, similarly to the later-described second flow control valve 36, an external pilot/external drain type high flow servo valve, in which a direct-operated high-speed linear servo valve is provided at the pilot stage to drive a main spool, can be used as the first flow control valve 34, and it is possible to directly perform opening/closing control by the controller 44. However, in the present embodiment, the high flow controller is used in terms of cost.

The first direction switching valve 35 is provided on a valve opening/closing pipe 37 extending from the pressure oil source 46 to the first flow control valve 34, and its opening/closing is controlled by the controller 44.

The logic valve 106 is a valve for opening/closing the first pressure oil path 30, and includes: a first port 106*a* which is connected to the pressure oil source 46 side of the first pressure oil path 30; a second port 106*b* which flows the pressure oil having passed through the first port 106*a*, out to the injection cylinder C; a poppet 106*c* which opens/closes the second port 106*b*; and a pilot connection port 106*d*. In addition, a pressing member 106*e* (a spring in the present embodiment) is provided between: the poppet 106*c* which slides in a casing; and a side surface of the casing in which the pilot connection port 106*d* is provided, and serves to press the poppet 106*c* toward the second port 106*b*.

A third pilot pressure oil path 110 is connected to the pilot connection port 106*d*, and branches from the first pressure oil path 30. The later-described third direction switching valve 102 is mounted on the third pilot pressure oil path 110. When the third direction switching valve 102 is opened, the pressure oil (namely, a pilot signal) of the pressure oil source 46 is provided to the pilot connection port 106*d* through the third pilot pressure oil path 110, whereby the second port 106*b* is closed.

The third direction switching valve 102 is a valve for switching a flowing direction of the pressure oil provided as the pilot signal to the logic valve 106, and includes a two-position four-way valve 102*a* and a solenoid 102*b* which switches the two-position four-way valve 102*a*.

Among these components, a B port of the two-position four-way valve 102*a* is blocked by a plug or the like. When the solenoid 102*b* of the third direction switching valve 102 is OFF, the pressure oil is supplied to the pilot connection port 106*d* of the logic valve 106 through the third pilot pressure oil path 110. When the solenoid 102*b* is turned to be ON, the pressure oil being supplied to the pilot connection port 106*d* of the logic valve 106 through the third pilot pressure oil path 110 is returned to the oil tank 48 through a pilot return pressure oil path 112 which is connected at one end thereof to a T port of the two-position four-way valve 102*a* and is connected at another end thereof to the second pressure oil path 32.

The third pressure oil path 33 is a flow path which communicates at one end thereof with the first pressure oil path 30 between the first flow control valve 34 and the logic valve 106 and is connected at another end thereof to the pressure oil source 46. The third flow control valve 100 is mounted on the third pressure oil path 33, and the pilot operation check valve 108 is also mounted on the third pressure oil path 33 on the pressure oil source 46 side of the third flow control valve 100.

The third flow control valve 100 serves to control a flow of the pressure oil flowing in the third pressure oil path 33. In the present embodiment, an electromagnetic proportional valve which controls its valve opening degree from full closing of a flow path to full opening of the flow path and can respond to a predetermined flow, is used as the third flow control valve 100.

The pilot operation check valve 108 is a valve which has a function: to serve as a normal check valve to open a flow path in only one direction in a state where a pilot signal (pressure oil) is not provided thereto; and to close the flow path in both directions in a state where the pilot signal is provided thereto.

The pilot operation check valve 108 is provided so as to allow the pressure oil to flow from the pressure oil source 46 toward the injection cylinder C.

The fourth direction switching valve 104 is provided on a pilot pipe 114 extending from the pressure oil source 46 to the pilot operation check valve 108, and includes a two-position four-way valve 104*a* and a solenoid 104*b* which switches the two-position four-way valve 104*a*. Opening/closing of the fourth direction switching valve 104 is controlled by the controller 44, and the fourth direction switching valve 104 is a valve for switching a flowing direction of the pressure oil provided as the pilot signal to the pilot operation check valve 108.

Among these components, a B port of the two-position four-way valve 104*a* is blocked by a plug or the like. When the solenoid 104*b* of the fourth direction switching valve 104 is OFF, the pressure oil is supplied to the pilot operation check valve 108 through the pilot pipe 114. When the solenoid 104*b* is turned to be ON, the pressure oil being supplied to the pilot operation check valve 108 is returned to the oil tank 48 through a pilot return pressure oil path 116 which is connected at one end thereof to a T port of the two-position four-way valve 104*a* and is connected at another end thereof to the second pressure oil path 32.

The second pressure oil path 32 is a flow path which communicates at one end thereof with the piston front chamber R2 of the injection cylinder C and is connected at another end thereof to the oil tank 48, thereby returning the pressure oil in the piston front chamber R2 to the oil tank 48. The second flow control valve 36 is mounted on the second pressure oil path 32, and the bypass pressure oil path 38 is also provided to the second pressure oil path 32 so as to bypass the second flow control valve 36.

The second flow control valve 36 serves to control a flow of the pressure oil flowing in the second pressure oil path 32. The hydraulic circuit 10 of the present embodiment employs, as the second flow control valve 36, an external pilot/external drain type high flow servo valve in which a direct-operated high-speed linear servo valve is provided at the pilot stage to drive a main spool.

As described above, the bypass pressure oil path 38 is a flow path for bypassing the second flow control valve 36 mounted on the second pressure oil path 32, and a direction logic valve 40 is mounted on the bypass pressure oil path 38.

The direction logic valve 40 is a valve for opening/closing the bypass pressure oil path 38, and includes: a first port 40*a* which is connected to the injection cylinder C side of the bypass pressure oil path 38; a second port 40*b* which flows the pressure oil having passed through the first port 40*a*, out to the bypass pressure oil path 38 on the oil tank 48 side; a poppet 40*c* which opens/closes the second port 40*b*; a pilot connection port 40*d*; and a side surface pilot connection port 40*e*. In addition, a circumferential direction groove is provided at a predetermined position in a longitudinal direction of the poppet 40*c* which slides in a casing, and a space 40*f* is formed between the circumferential direction groove and an inner wall of the casing. The pressure oil (pilot signal) is supplied to the space 40*f* through the side surface pilot connection port 40*e*, and the direction logic valve 40 is formed such that an inner diameter D1 thereof on the pilot connection port 40*d* side including the space 40*f* is larger than an inner diameter D2 thereof on the first port 40*a*/second port 40*b* side of the space 40*f*.

A first pilot pressure oil path 50 is connected to the pilot connection port 40*d* among these components, and branches from the first pressure oil path 30. When the later-described second direction switching valve 42 is opened, the pressure oil (namely, the pilot signal) of the pressure oil source 46 is provided to the pilot connection port 40*d* through the first pilot pressure oil path 50, whereby the second port 40*b* is closed.

Further, a second pilot pressure oil path 52 is connected to the side surface pilot connection port 40*e*, and branches from the first pilot pressure oil path 50. In a state where the pilot signal is not provided to the pilot connection port 40*d* (a closed state of the second direction switching valve 42), by the pressure oil of the pressure oil source 46 being provided to the side surface pilot connection port 40*e* through the second pilot pressure oil path 52, the poppet 40*c* having closed the second port 40*b* is immediately moved back toward the pilot connection port 40*d* and the second port 40*b* is instantly opened, since the inner diameter D1 is larger than the inner diameter D2.

The second direction switching valve 42 is mounted on the first pilot pressure oil path 50 connected to the pilot connection port 40*d* (specifically, on the direction logic valve 40 side of the branching position of the second pilot pressure oil path 52).

The second direction switching valve 42 is a valve for switching a flowing direction of the pressure oil provided as the pilot signal to the direction logic valve 40, and includes a two-position four-way valve 42*a* and a solenoid 42*b* which switches the two-position four-way valve 42*a*.

Among these components, a B port of the two-position four-way valve 42*a* is blocked by a plug or the like. When the solenoid 42*b* of the second direction switching valve 42 is OFF, the pressure oil is supplied to the pilot connection port 40*d* of the direction logic valve 40 through the first pilot pressure oil path 50. When the solenoid 42*b* is turned to be ON, the pressure oil being supplied to the pilot connection port 40*d* of the direction logic valve 40 through the first pilot pressure oil path 50 is returned to the oil tank 48 through a pilot return pressure oil path 54 which is connected at one end thereof to a T port of the two-position four-way valve 42*a* and is connected at another end thereof to the second pressure oil path 32.

The controller 44 serves to control operations of the first flow control valve 34, the second flow control valve 36, the first and second direction switching valves 35 and 42, and the like such that the injection cylinder C performs a predetermined operation, and includes a sequencer 44*a*, an operation part 44*b*, and a display part 44*c*.

The sequencer 44*a* serves to control an operation of the injection cylinder C by outputting command signals (e.g., pulse signals) based on a predetermined program to the first flow control valve 34, the second flow control valve 36, the first direction switching valve 35, the second direction switching valve 42, the third flow control valve 100, the third direction switching valve 102, the fourth direction switching valve 104, which are connected to the wires 56*a*, 56*b*, 56*c*, 56*d*, 56*e*, 56*f*, and 56*g*, respectively, and the like. In addition, the operation part 44*b* is provided with switches for performing activation and stop of the injection cylinder C, a keyboard and a touch panel for changing the program of the sequencer 44*a*, and the like, and the display part 44*c* serves to display a state of the injection cylinder C controlled by the sequencer 44*a*.

In the hydraulic circuit 10 configured as described above, a known return circuit (not shown) for the piston P of the injection cylinder C is integrally provided. During returning of the piston P, the pressure oil is supplied from the hydraulic pump 70 to the piston front chamber R2, and the pressure oil in the piston rear chamber R1 is returned to the oil tank 48.

Next, a method of controlling the injection cylinder C including the aforementioned hydraulic circuit 10 will be described in order of the case of "IN restriction", the case of "OUT restriction", and the case of "IN+OUT restriction".

(Case of "IN Restriction")

Figure 3:
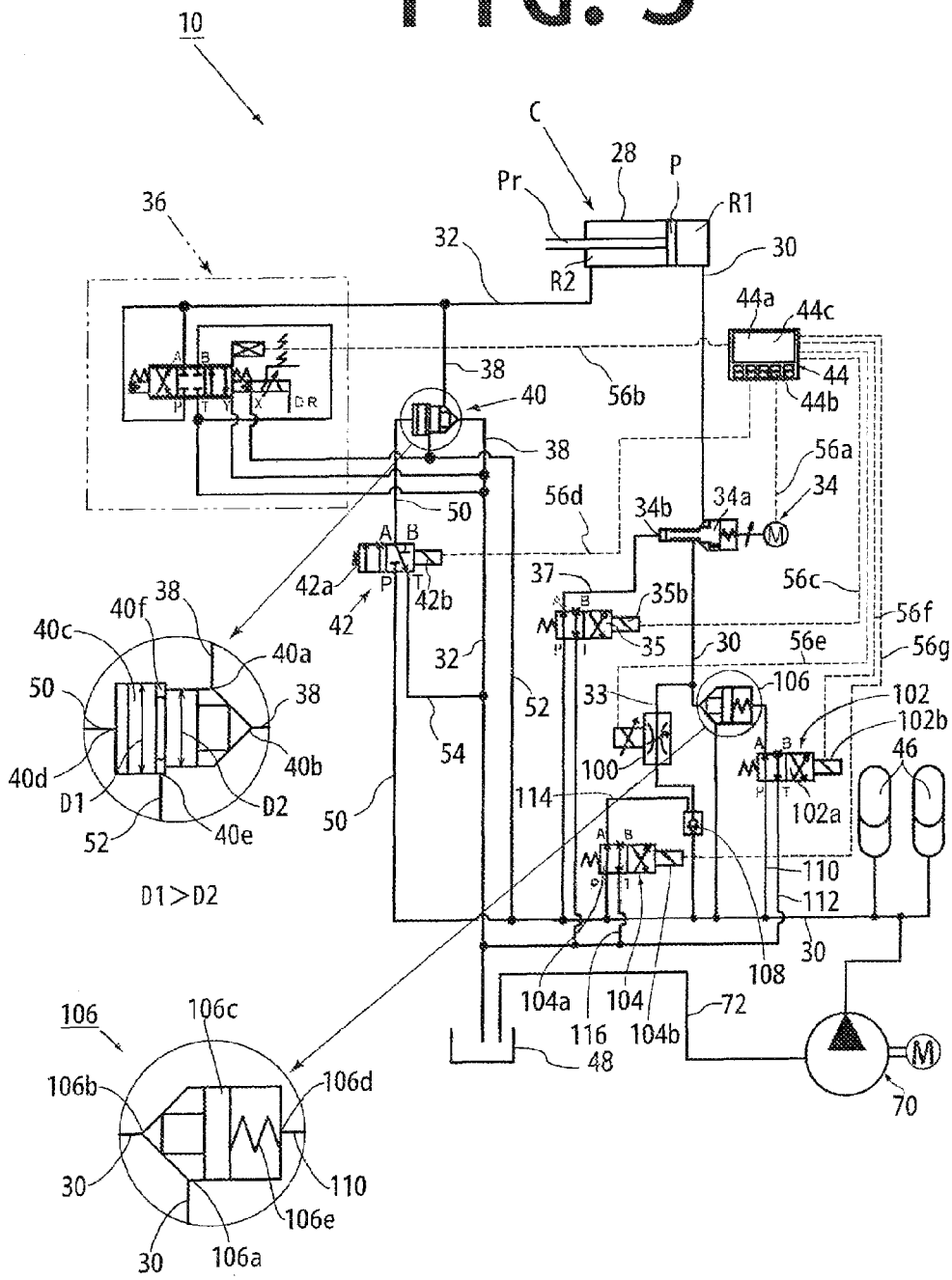
FIG. 3 is a circuit diagram showing a main portion in the case where the hydraulic circuit of the present invention is set to be a circuit for IN restriction.
Figure 4:
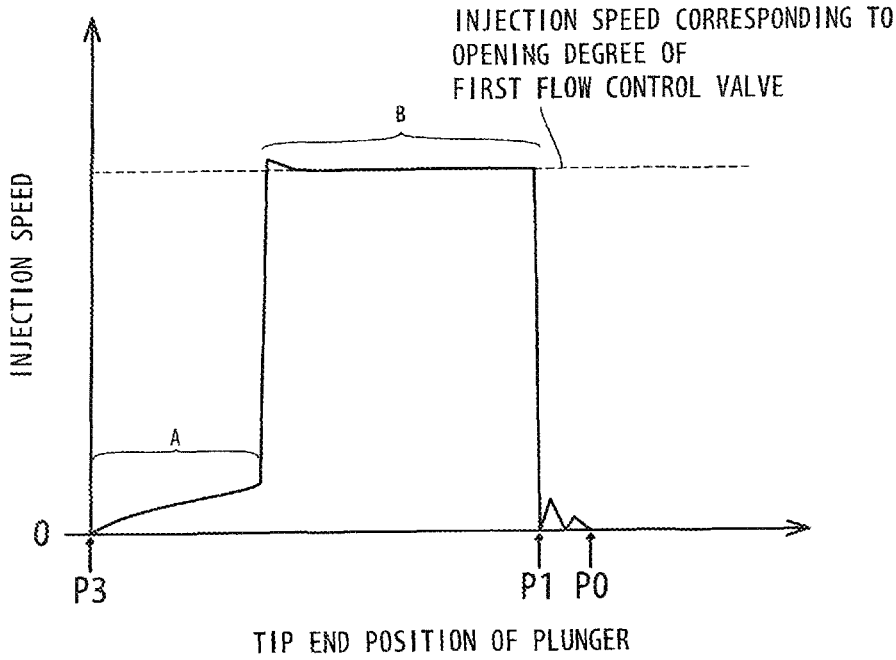
FIG. 4 is a movement diagram showing a movement of a plunger in the case of IN restriction.
Figure 5:
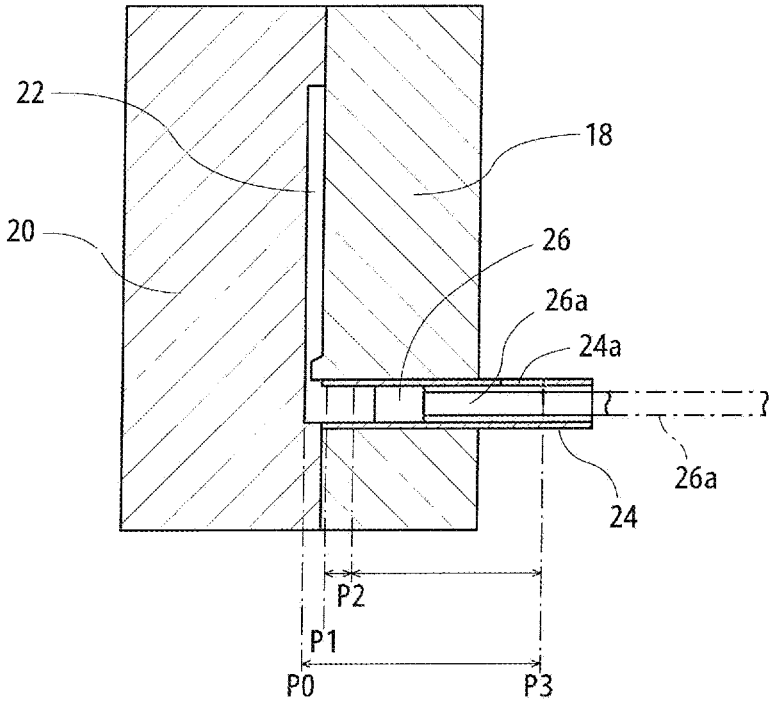
FIG. 5 is an explanatory diagram showing a state of the plunger actuated by the hydraulic circuit of the present invention.

First, in a state where the piston P of the injection cylinder C is located at a start position on the piston rear chamber R1 side, the controller 44 opens the first direction switching valve 35 (turns the solenoid 35*b* to be OFF), closes the second direction switching valve 42 (turns the solenoid 42*b* to be ON), opens the third direction switching valve 102 (turns the solenoid 102*b* to be OFF), and opens the fourth direction switching valve 104 (turns the solenoid 104*b* to be OFF), as shown in FIG. 3. In addition, the second flow control valve 36 is fully closed by the controller 44. FIG. 4 shows a movement of the plunger 26 in the case of "IN restriction", and FIG. 5 shows positions of the plunger 26 corresponding to P0 to P3 in the movement diagram.

In this state, by the first direction switching valve 35 being opened, the pressure oil having passed through the valve opening/closing pipe 37 moves a valve element 34*a* of the first flow control valve 34 against the built-in spring to open the first pressure oil path 30 at the first flow control valve 34 with a predetermined control opening degree of the first flow control valve 34 controlled by the controller 44 being as a limit.

In addition, by the second direction switching valve 42 being closed, the pressure oil in the first pilot pressure oil path 50 moves to the oil tank 48, and, at the same time, the pressure oil having passed from the first pressure oil path 30 through the second pilot pressure oil path 52 enters the space 40*f* of the direction logic valve 40 through the side surface pilot connection port 40*e*. At this time, since the inner diameter D1 is larger than the inner diameter D2, the poppet 40*c* moves toward the pilot connection port 40*d*. As a result, a flow path between the first port 40*a* and the second port 40*b* is opened, whereby the bypass pressure oil path 38 is opened.

Further, by the third direction switching valve 102 being opened, the pressure oil from the pressure oil source 46 is supplied to the pilot connection port 106*d* of the logic valve 106 through the third pilot pressure oil path 110 to close the second port 106*b* of the logic valve 106, whereby the first pressure oil path 30 is closed.

Moreover, by the fourth direction switching valve 104 being opened, the pressure oil from the pressure oil source 46 is supplied to the pilot operation check valve 108 through the pilot pipe 114, and the third pressure oil path 33 is closed by the pilot operation check valve 108. In this manner, the paths 30 and 33 for supplying the pressure oil from the pressure oil source 46 to the injection cylinder C are all closed, and thus supply of the pressure oil to the injection cylinder C is stopped.

In this state, first, the controller 44 turns the solenoid 104*b* of the fourth direction switching valve 104 to be ON to close the fourth direction switching valve 104. By so doing, the pressure oil being supplied to the pilot operation check valve 108 is returned to the oil tank 48, and the pilot operation check valve 108 opens the third pressure oil path 33 for flowing of the pressure oil from the pressure oil source 46 toward the injection cylinder C. By so doing, the pressure oil of the pressure oil source 46 moves from the pilot operation check valve 108 through the third flow control valve 100 to the first pressure oil path 30, further passes through the first flow control valve 34 which has been opened at a set opening degree, and then is introduced to the piston rear chamber R1 of the injection cylinder C.

After the pilot operation check valve 108 is opened, the controller 44 controls the third flow control valve 100 so as to gradually increase an amount of the pressure oil which can flow per unit time (hereinafter, referred to merely as "pressure oil flow amount") at the third flow control valve 100. As the pressure oil flow amount of the third flow control valve 100 gradually increases, the inflow speed of the pressure oil into the injection cylinder C also gradually increases, and the injection speed of the injection cylinder C also gradually increases (a portion A in FIG. 4).

When the pressure oil flow amount of the third flow control valve 100 increases and the injection cylinder C reaches a predetermined injection speed, the controller 44 turns the solenoid 102*b* of the third direction switching valve 102 to be ON to close the third direction switching valve 102. By so doing, the pressure oil being supplied to the pilot connection port 106*d* of the logic valve 106 is returned to the oil tank 48 through the pilot return pressure oil path 112, and the poppet 105*c* of the logic valve 106 receives a pressing force from the pressure oil through the first port 106*a* and moves toward the pilot connection port 106*d*, whereby the second port 106*b* is opened.

When the second port 106*b* of the logic valve 106 is opened, the pressure oil from the pressure oil source 46 is immediately introduced through the first pressure oil path 30 (the logic valve 106 and the first flow control valve 34 provided thereon) to the injection cylinder C. Thus, the inflow speed of the pressure oil into the injection cylinder C rapidly increases to a pressure oil flow amount corresponding to the set opening degree of the first flow control valve 34 which is previously set, and the injection speed rapidly increases, accordingly (a portion B in FIG. 4).

when the pressure oil is supplied to the piston rear chamber R1, the pressure oil remaining in the piston front chamber R2 moves to the oil tank 48, without time lag, through the first port 40*a* and the second port 40*b* of the direction logic valve 40 which have been opened. Thus, a molten metal is loaded by injection at a high speed.

Subsequently, when the plunger 26 reaches a plunger stop position P1 shown in FIG. 5, a booster cylinder (not shown) connected to the piston rear chamber R1 of the injection cylinder C starts operating to move the plunger 26 forward to an injection loading end position P0 shown in FIG. 5 to apply a pressure to the molten metal in the cavity 22 (a molten metal pressing effect) for cooling and solidifying the molten metal.

Then, when solidification of the molten metal is completed, the solenoid 42*b* of the second direction switching valve 42 is turned to be ON by the controller 44, and a return circuit system, which is not shown, is switched to, whereby the pressure oil is supplied to the piston front chamber R2 and the pressure oil supplied to the piston rear chamber R1 is returned to the oil tank 48. Thus, the piston P of the injection cylinder C is returned to the start position, and a one-cycle operation of the injection cylinder C is completed.

As described above, by closing the second direction switching valve 42, the hydraulic circuit 10 in IN restriction is formed. Note that, when the piston P of the injection cylinder C is located at the start position, the tip end of the plunger 26 is located at a position P3 which is a most backward position in the sleeve 24, as shown in FIG. 5.

(Case of "OUT Restriction")

Figure 6:
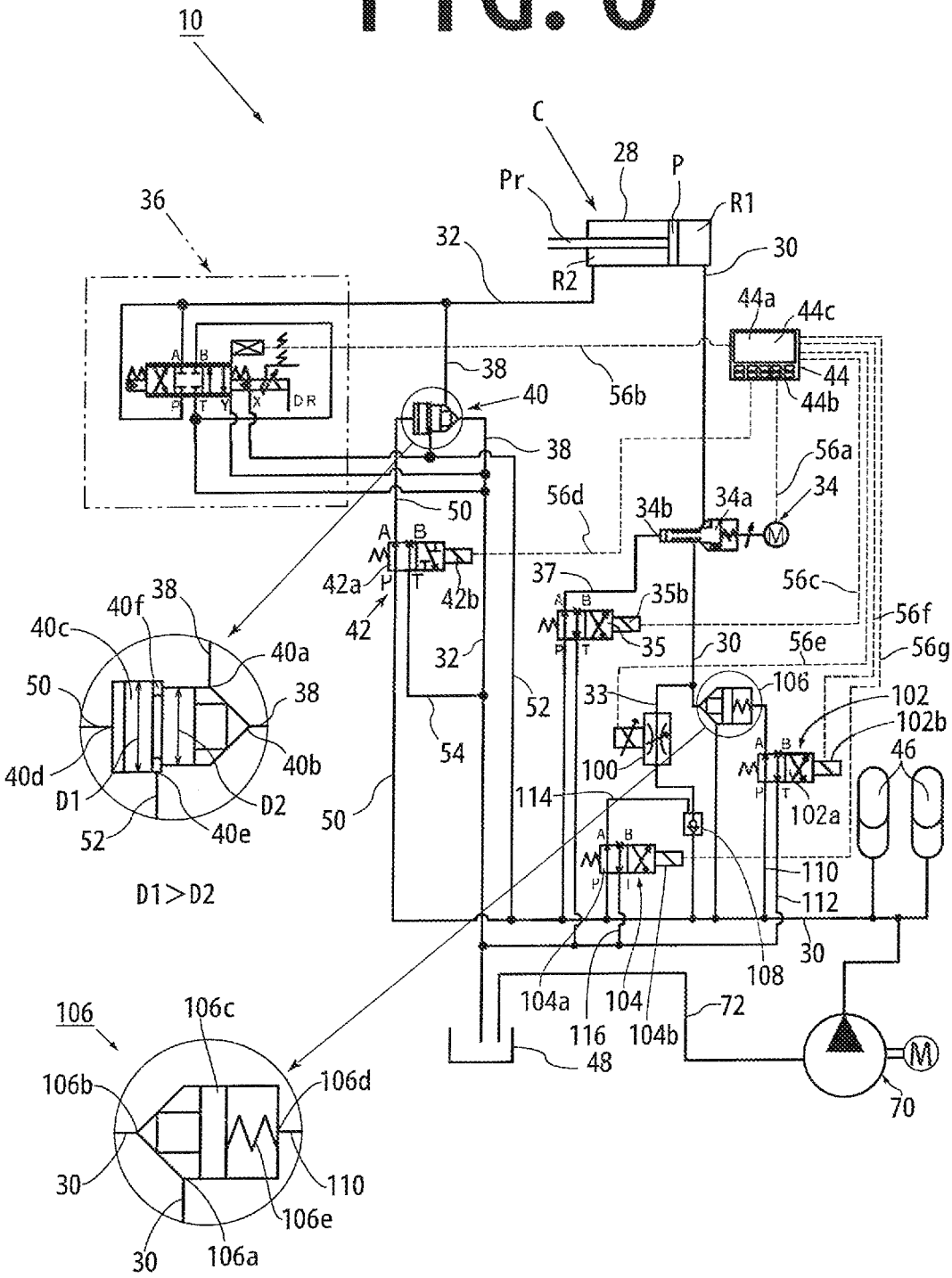
FIG. 6 is a circuit diagram showing a main portion in the case where the hydraulic circuit of the present invention is set to be a circuit for OUT restriction.
Figure 7:
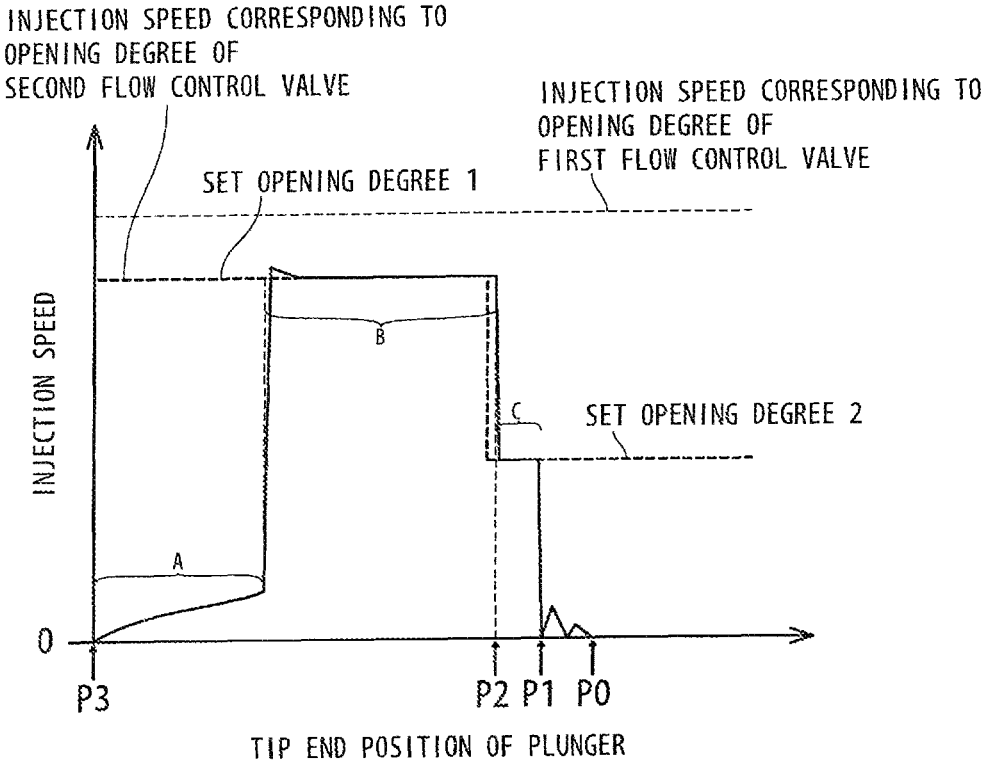
FIG. 7 is a movement diagram showing a movement of the plunger in the case of OUT restriction.

First, in a state where the piston P of the injection cylinder C is located at the start position on the piston rear chamber R1 side, the controller 44 opens the first direction switching valve 35 (turns the solenoid 35*b* to be OFF), opens the second direction switching valve 42 (turns the solenoid 42*b* to be OFF), opens the third direction switching valve 102 (turns the solenoid 102*b* to be OFF), and opens the fourth direction switching valve 104 (turns the solenoid 104*b* to be OFF), as shown in FIG. 6. FIG. 7 shows a movement of the plunger 26 in the case of "OUT restriction".

In addition, the opening degree of the second flow control valve 36 is previously set by the controller 44 such that a pressure oil flow amount of the second flow control valve 36 is smaller than a pressure oil flow amount of the first flow control valve 34.

In this state, by the first direction switching valve 35 being opened, similarly to the case of "IN restriction", the first pressure oil path 30 at the first flow control valve 34 is opened with a predetermined control opening degree being as a limit.

In addition, by the second direction switching valve 42 being opened, the pressure oil is provided as a pilot signal to the pilot connection port 40*d* of the direction logic valve 40, and the poppet 40*c* moves, whereby the direction logic valve 40 is instantly closed to close the bypass pressure oil path 38.

Further, by the third direction switching valve 102 being opened and the fourth direction switching valve 104 being opened, similarly to the case of "IN restriction", the first pressure oil path 30 is closed by the logic valve 106, and the third pressure oil path 33 is closed by the pilot operation check valve 108. In this manner, the paths 30 and 33 for supplying the pressure oil from the pressure oil source 46 to the injection cylinder C are all closed, and thus supply of the pressure oil to the injection cylinder C is stopped.

In this state, first, the controller 44 turns the solenoid 104*b* of the fourth direction switching valve 104 to be ON to close the fourth direction switching valve 104. By so doing, similarly to the case of "IN restriction", the pressure oil being supplied to the pilot operation check valve 108 is returned to the oil tank 48, and the pilot operation check valve 108 opens the third pressure oil path 33 for flowing of the pressure oil from the pressure oil source 46 toward the injection cylinder C. By so doing, the pressure oil of the pressure oil source 46 moves from the pilot operation check valve 108 through the third flow control valve 100 to the first pressure oil path 30, further passes through the first flow control valve 34, and then is introduced to the piston rear chamber R1 of the injection cylinder C.

After the pilot operation check valve 108 is opened, the controller 44 controls the opening degree of the third flow control valve 100 so as to gradually increase the pressure oil flow amount of the third flow control valve 100. Then, as the opening degree of the third flow control valve 100 gradually increases, the inflow speed of the pressure oil into the injection cylinder C also gradually increases, and the injection speed of the injection cylinder C also gradually increases (a portion A in FIG. 7).

When the pressure oil flow amount of the third flow control valve 100 increases and the injection cylinder C reaches a predetermined injection speed, the controller 44 turns the solenoid 102*b* of the third direction switching valve 102 to be ON to close the third direction switching valve 102. By so doing, the pressure oil being supplied to the pilot connection port 106*d* of the logic valve 106 is returned to the oil tank 48 through the pilot return pressure oil path 112, and the poppet 106*c* of the logic valve 106 receives a pressing force from the pressure oil through the first port 106*a* and moves toward the pilot connection port 106*d*, whereby the second port 106*b* is opened.

When the second port 106*b* of the logic valve 106 is opened, the pressure oil from the pressure oil source 46 is immediately introduced through the first pressure oil path 30 (the logic valve 106 and the first flow control valve 34 provided thereon) to the injection cylinder C.

At this time, since the opening degree ("set opening degree 1" in FIG. 7) of the second flow control valve 36 is previously set such that the pressure oil flow amount of the second flow control valve 36 is smaller than the pressure oil flow amount of the first flow control valve 34, the inflow speed of the pressure oil into the injection cylinder C also rapidly increases to a speed corresponding to the set opening degree of the second flow control valve 36 which is previously set, and the injection speed of the injection cylinder C also rapidly increases, accordingly (a portion B in FIG. 7).

Subsequently, when the plunger 26 reaches a position P2 in FIG. 5, the controller 44 rapidly reduces the opening degree of the second flow control valve 36 to a previously-set opening degree ("set opening degree 2" in FIG. 7) to rapidly decrease the inflow speed of the pressure oil into the injection cylinder C (a portion C in FIG. 7).

Here, the position P2 is a critical position which causes occurrence of burrs in a product when the plunger 26 is actuated to load the molten metal into the cavity 22 by injection immediately before the end of injection loading and in a state of being at a high speed where inertial forces are great. For example, the position P2 can be determined by comparing a state of burrs in a product and a deceleration position of the plunger 26, or can be determined by detecting a surge pressure with a pressure gauge or the like.

Thereafter, when the plunger 26 reaches the plunger stop position P1 shown in FIG. 5, the booster cylinder, which is not shown, starts operating to cool and solidify the molten metal. Then, the piston P of the injection cylinder C is returned to the start position, and a one-cycle operation of the injection cylinder C is completed, similarly to the case of "IN restriction".

As described above, by opening the second direction switching valve 42, the hydraulic circuit 10 in OUT restriction is formed.

Therefore, according to the hydraulic circuit 10, a hydraulic circuit of an injection cylinder in a die-casting apparatus, which can achieve IN restriction and OUT restriction in a quickly switchable manner with a single circuit and which allows manufacturing of a high-quality molded product, can be provided.

(Case of "IN+OUT Restriction")

Figure 8:
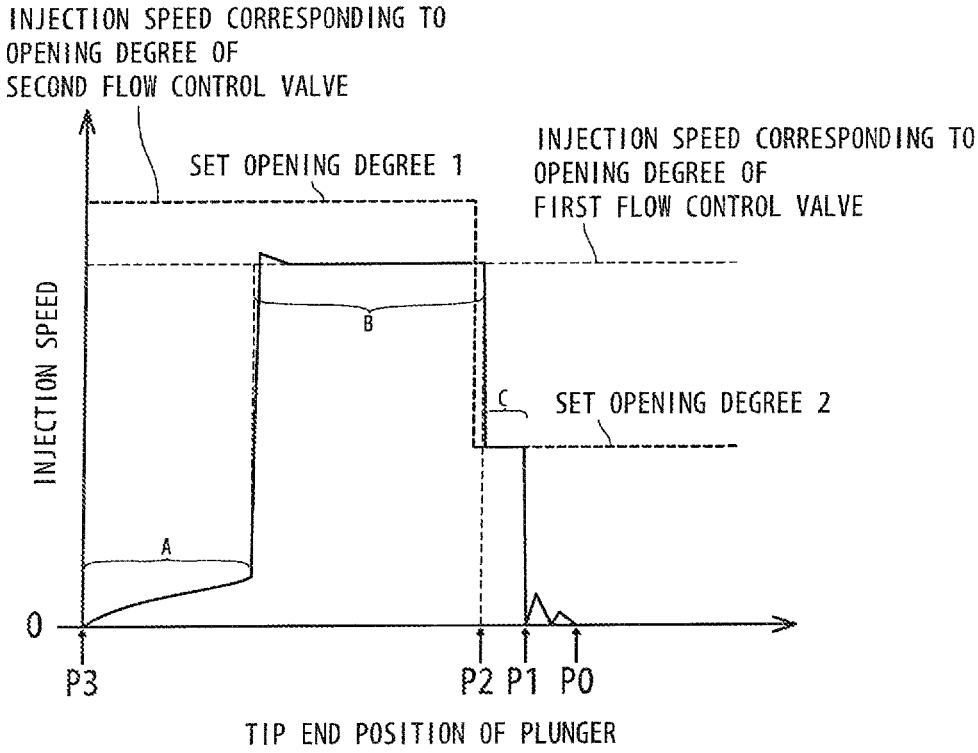
FIG. 8 is a movement diagram showing a movement of the plunger in the case of IN+OUT restriction.
Figure 9:
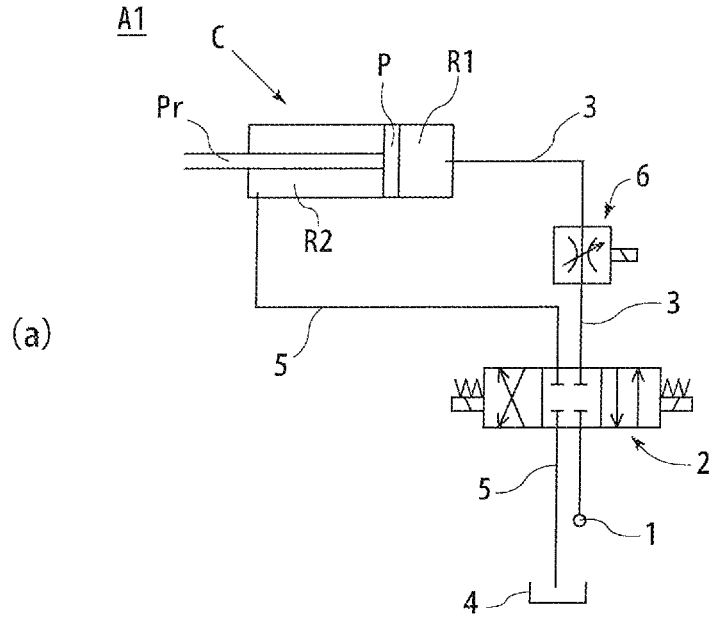
FIG. 9 is circuit diagrams each showing a conventional hydraulic circuit of an injection cylinder, (a) shows a hydraulic circuit for IN restriction, and (b) shows a hydraulic circuit for OUT restriction.
Figure 9:
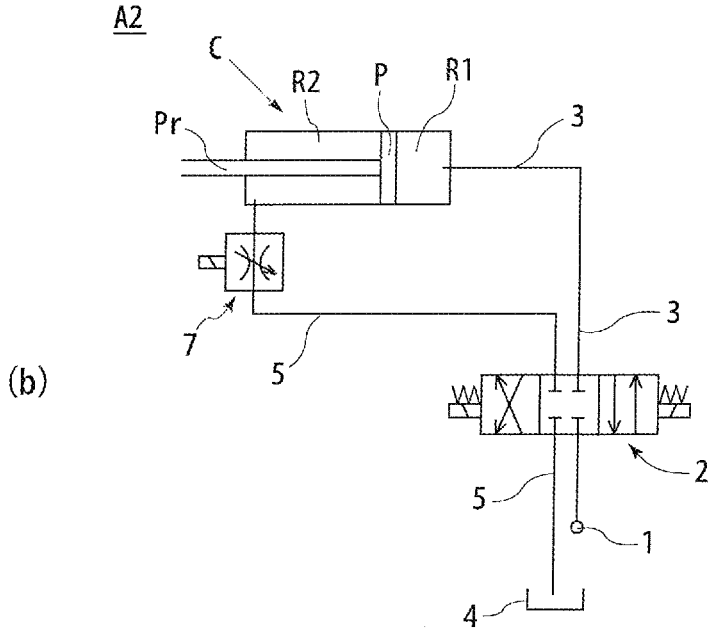
Figure 10:
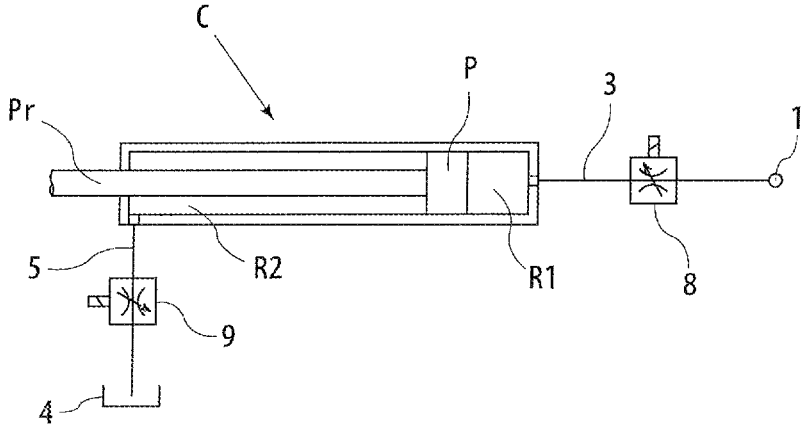
FIG. 10 is a circuit diagram showing a modified example of a conventional hydraulic circuit of an injection cylinder.

"IN+OUT restriction" is a method in which an operation from the start position P3 for injection loading of the molten metal to the position P2, which is immediately prior to the end of the injection loading, is performed as in "IN restriction", and in which an operation from the position P2, which is immediately prior to the end of the injection loading, to the plunger stop position P1 is performed as in "OUT restriction". FIG. 8 shows a movement of the plunger 26 in the case of "IN+OUT restriction".

Specifically, first, the opening degree of the second flow control valve 36 is set ("a set opening degree 1" in FIG. 8) such that the pressure oil flow amount of the second flow control valve 36 is larger than the pressure oil flow amount of the first flow control valve 34, and the solenoid 42*b* of the second direction switching valve 42 is turned to be OFF to open the second direction switching valve 42, thereby causing a state where the direction logic valve 40 closes the bypass pressure oil path 38 (that is, a state of each of the switching valves 35, 42, 102, and 104 becomes the same as in FIG. 6).

Thereafter, the fourth direction switching valve 104 is closed and the opening degree of the third flow control valve 100 is gradually increased, whereby the injection speed of the injection cylinder C gradually increases (a portion A in FIG. 8). When the injection speed of the injection cylinder C reaches a predetermined injection speed, the third direction switching valve 102 is closed, whereby the pressure oil flows into the injection cylinder C in a pressure oil flow amount corresponding to a set opening degree of the first flow control valve 34 (namely, "IN restriction") and the piston P moves forward toward the piston front chamber R2 at a high speed (a portion B in FIG. 8). At this time, the pressure oil remaining in the piston front chamber R2 is returned to the oil tank 48, without receiving resistance, through the second pressure oil path 32 and the second flow control valve 36 of which the pressure oil flow amount is set so as to be larger than the pressure oil flow amount of the first flow control valve 34.

Subsequently, when the plunger 26 reaches the position P2 in FIG. 5, the controller 44 rapidly reduces the opening degree of the second flow control valve 36 to a previously-set opening degree ("set opening degree 2" in FIG. 8) such that the pressure oil flow amount of the second flow control valve 36 is smaller than the pressure oil flow amount of the first flow control valve 34, to rapidly decrease the inflow speed of the pressure oil into the injection cylinder C (OUT restriction). Then, until the plunger 26 reaches the plunger stop position P1 shown in FIG. 5, the injection cylinder C is actuated at a low speed with the hydraulic circuit 10 for OUT restriction (a portion C in FIG. 8).

According to "IN+OUT restriction" described above, the hydraulic circuit 10 in IN restriction, in which power is high and filling with the molten metal for a product is good, is formed at the start of the injection operation of the injection cylinder C, and the hydraulic circuit 10 in OUT restriction, in which speed adjustment is easy, is formed at the time immediately before the end of the injection operation of the injection cylinder C, at which fine speed control is required. Thus, a surge pressure can be prevented from excessively occurs in the cavity 22, and burrs do not occur. In addition, the emitted speed of the molten metal is increased by using a mold having a small supply port. Therefore, a high-quality molded product, which is entirely and sufficiently filled with the molten metal and which has no defect in shape, can be manufactured.

Therefore, the "predetermined position" is a position at which a surge pressure detected in the cavity 22 exceeds a predetermined value. When a position at which a surge pressure increases is previously known, position control is also possible.

What is claimed is:

1. A hydraulic circuit of an injection cylinder in a die-casting apparatus, the hydraulic circuit comprising:

a first pressure oil path supplying pressure oil from a pressure oil source to a piston rear chamber of the double-acting injection cylinder moving forward/backward a plunger connected to a piston rod;

a second pressure oil path returning the pressure oil from a piston front chamber of the injection cylinder to an oil tank;

a first flow control valve controlling a pressure oil flow amount in the first pressure oil path;

a second flow control valve controlling a pressure oil flow amount in the second pressure oil path;

a bypass pressure oil path connected to the second pressure oil path so as to bypass the second flow control valve;

a bypass on-off valve provided on the bypass pressure oil path and having a pressure oil flow amount per unit time which is larger than the pressure oil flow amount of the first flow control valve per unit time; and a controller controlling the first flow control valve, the second flow control valve, and the bypass on-off valve, wherein in injection, before the start of the forward movement of the piston rod, the controller closes the bypass on-off valve and opens the first control valve and the second control valve, and the controller makes the pressure oil flow amount of the second control valve larger than the pressure oil flow amount of the first control valve, at a time when the piston rod moves forward to a set position, the controller reduces an opening degree of the second flow control valve so as to decrease the pressure oil flow amount of the second flow control valve per unit time to be smaller than the pressure oil flow amount of the first flow control valve per unit time and to follow a set value.

2. The hydraulic circuit of the injection cylinder in the die-casting apparatus according to claim 1, wherein an opening degree of the first flow control valve is adjusted with a motor, the bypass on-off valve is a direction logic valve opening/closing the bypass pressure oil path with the pressure oil from the pressure oil source as a pilot signal, and the hydraulic circuit further comprises:

a first direction switching valve controlled by the controller so as to open/close the first flow control valve; and a second direction switching valve controlled by the controller and switching a flowing direction of the pressure oil provided as the pilot signal to the direction logic valve.

* * * * *